United States Patent [19]

Silvey

[11] 4,300,466

[45] Nov. 17, 1981

[54] HYDRODYNAMIC DEVICES

[75] Inventor: Trevor I. Silvey, Sherborne, England

[73] Assignee: Plessey Handel und Investments AG, Zug, Switzerland

[21] Appl. No.: 68,409

[22] Filed: Aug. 21, 1979

[30] Foreign Application Priority Data

Oct. 14, 1978 [GB] United Kingdom ..... 40863/78

[51] Int. Cl.[3] ..... B63G 8/42

[52] U.S. Cl. ..... 114/244

[58] Field of Search ..... 114/244, 245, 243; 9/8 R, 8.3, 9; 455/96, 97, 99; 367/106, 130, 131

[56] References Cited

U.S. PATENT DOCUMENTS 3,352,118 11/1967 Burkhardt ..... 114/243
3,500,209 3/1970 Fletcher et al. ..... 9/8 R
3,953,905 5/1976 Paitson ..... 9/8 R
4,055,138 10/1977 Klein ..... 114/244

*Primary Examiner*—Edward R. Kazenske
*Assistant Examiner*—Jesus D. Sotelo
*Attorney, Agent, or Firm*—Fleit & Jacobson

[57] ABSTRACT

A hydrodynamic device comprising first and second parts which are connected together such that the first part is movable from a storage position in which it lies adjacent to the second part to an operable position in which it upstands from and extends from one end portion of the second part, the second part comprising an elongate member having (a) a plurality of transversely extending hydrofoil elements, and (b) a tow bar for enabling a connection to be made between the hydrodynamic device and a towing vessel whereby the hydrodynamic device can be towed in water with the first part visible above the water and the second part submerged.

8 Claims, 15 Drawing Figures

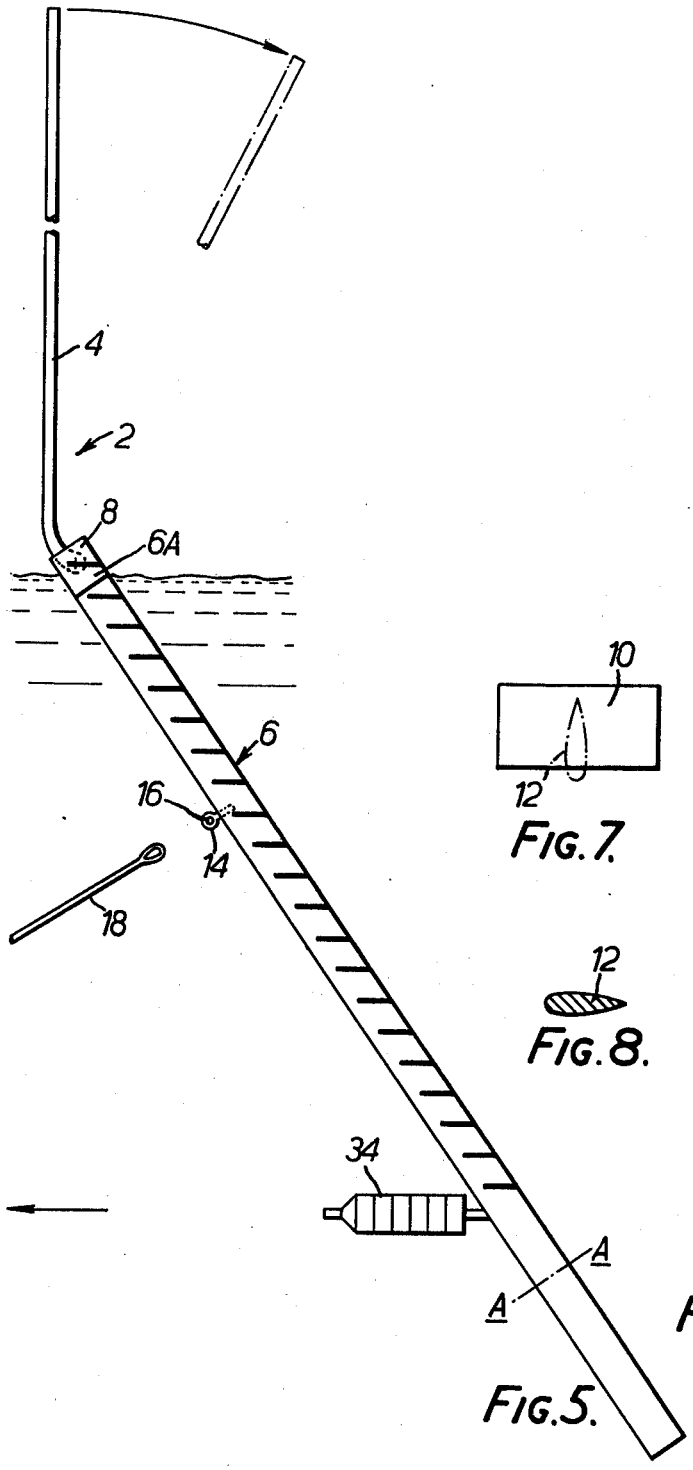
FIG. 5.
FIG. 7.
FIG. 8.
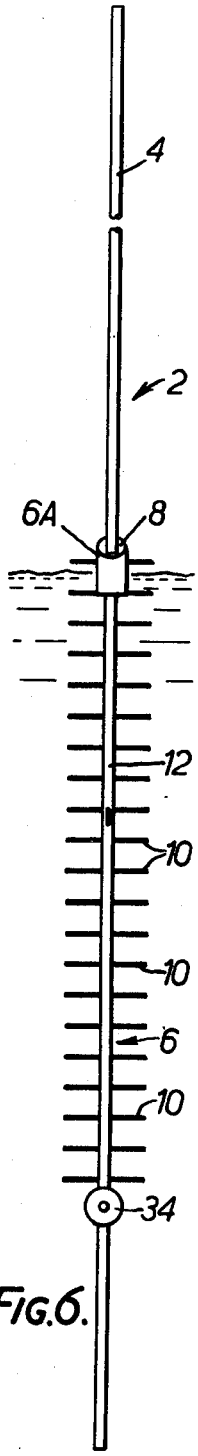
FIG. 6.

HYDRODYNAMIC DEVICES

This invention relates to a hydrodynamic device.

More specifically, this invention relates to a hydrodynamic device comprising first and second parts which are connected together such that the first part is movable from a storage position in which it lies adjacent to the second part to an operable position in which it upstands from and extends from one end portion of the second part, the second part comprising an elongate member having (a) a plurality of transversely extending hydrofoil elements, and (b) towing means for enabling a connection to be made between the hydrodynamic device and a towing vessel whereby the hydrodynamic device can be towed in water with the first part visible above the water and the second part submerged.

The hydrodynamic device of the invention is designed so that it can be towed through the water without creating much wake. The hydrodynamic device is also designed to be vertically stable in use so that it can operate in high sea conditions. The device is non-buoyant in water and its characteristics are controlled by its second part which is thus hydrodynamically more important than its first part.

Preferably, the first and second parts are connected together by a sprung hinge arrangement. Such an arrangement allows the first part to easily and automatically move from its stored position to its upstanding operable position. Alternative arrangements for connecting the first and second parts together include a simple pivot whereby the first part can be moved from its stored position to its upstanding position merely by the use of appropriate hydrodynamic and aerodynamic vanes or by a counter balance weight system.

Advantageously, the first and second parts are so connected together that the first part lies substantially exactly flat. In order to achieve this, the precise arrangement by which the first and second parts are connected together may include auxiliary means such for example as a push rod which engages on a storage platform for getting the first part in the desired substantially flat condition.

Preferably, the hydrofoil elements are spaced apart by spacer elements.

The pair of hydrofoil elements that are uppermost when the device is being towed through the water may be provided with drag vanes for controlling the depth at which the second part is submerged. The drag vanes make the hydrodynamic device very sensitive to small depth variations.

Preferably, the towing means is a towing eye but it is to be appreciated that other devices can be employed.

The first part may be constituted by an aerial, a marker, a target or a radar reflector.

The hydrodynamic device may include weighting means, for example positioned on the end portion of the second part that is remote from the first part, for stabilizing the hydrodynamic device and for causing it to tow in a vertical or an inclined position.

Embodiments of the invention will now be described solely by way of example and with reference to the accompanying drawings in which:

FIG. 5 is a side view of a second hydrodynamic device in accordance with the invention, FIG. 6 is an end view of the device shown in FIG. 5;

FIGS. 7 and 8 show detailed parts of the device shown in FIG. 5;

Figure 1:
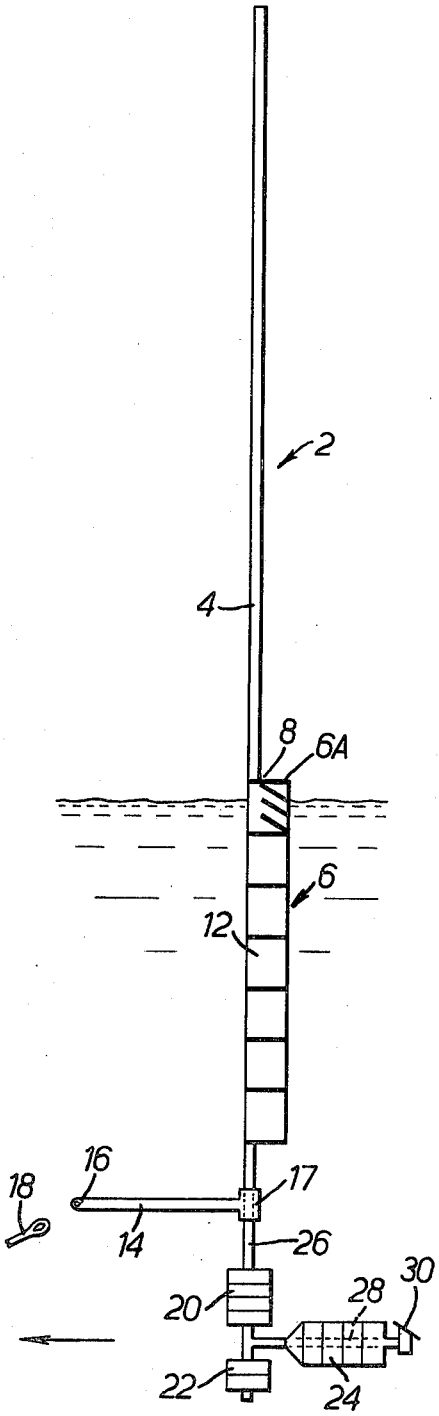
FIG. 1 is a side view of a first hydrodynamic device in accordance with the invention.

Referring to FIGS. 1 to 4, there is shown a hydrodynamic device 2 comprising a first part 4 in the form of a flexible aerial, and a second part 6. The first and second parts 4, 6 are connected together by a hinge arrangement located at position 8, the hinge arrangement being such that the first part 4 is movable from a storage position in which it lies adjacent to the second part 6 to an operable position in which it stands up and extends from an end portion 6A of the second part 6.

The second part 6 comprises an elongate member having a plurality of transversely extending hydrofoil elements 10 positioned on a shaped elongate fairing member 12 which reacts with the water flow in a manner which gives the device vertical stability. The second part 6 further comprises towing means in the form of a tow bar 14 for enabling a connection to be made between the hydrodynamic device 2 and a towing vessel (not shown) whereby the hydrodynamic device can be towed in water with the first part visible above the water and the second part submerged. The tow bar 14 is provided at one end with a towing eye 16 for receiving a tow line 18 and at the other end a pivot 17 allowing freedom of rotation of the tow bar 14 about a shaft 26 in the elongate member.

Positioned beneath the tow bar 14 are a plurality of weights 20, 22, 24 which are attached to the shaft 26 and which are effective to balance the hydrodynamic device 2. Positioned aft of the weight 24 and on a shaft 28 is a rectangular damper plate 30.

Figure 2:
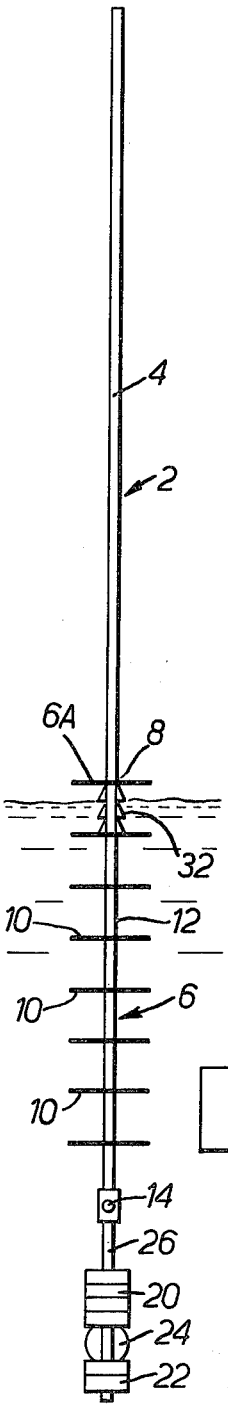
FIG. 2 is an end view of the device shown in FIG. 1.
Figure 4:
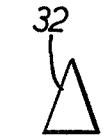
FIGS. 3 and 4 show detailed parts of the device shown in FIG. 1.
Figure 3:
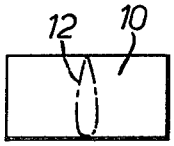

As shown most clearly in FIG. 2, three drag vanes 32 are provided between the two uppermost hydrofoil elements 10. These drag vanes 32 are effective to control the depth at which the second part 6 is submerged. The drag vanes 32 make the hydrodynamic device 2 very sensitive to small depth variations, such that it can follow water surface wave profiles.

Referring now to FIGS. 5 to 8, similar parts as in FIGS. 1 to 4 have been given the same reference numeral and their construction and operation will not again be given in order to avoid undue repetition of description.

It will be noted that the hydrodynamic device 2 illustrated in FIGS. 5 to 8 has a smaller tow bar 14 than in the hydrodynamic device 2 illustrated in FIGS. 1 to 4 and that the tow bar pivot 17 is no longer required. Also, in the hydrodynamic device 2 illustrated in FIGS. 5 to 8, only a single weight 34 is employed and there are no drag vanes 32 or damper plate 30.

Figure 9:
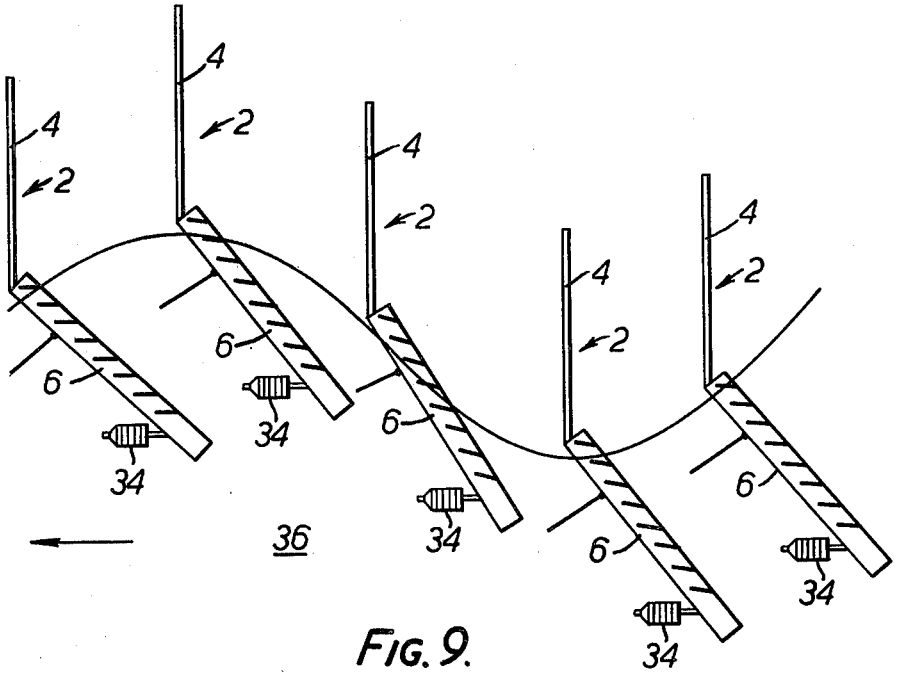
FIGS. 9 and 10 show the device somewhat schematically as it is being towed through water.

In FIG. 9, there are shown a plurality of the hydrodynamic devices 2 illustrated in FIGS. 5 to 8, these devices 2 being illustrated as they follow the wave profile of the sea 36.

Figure 10:
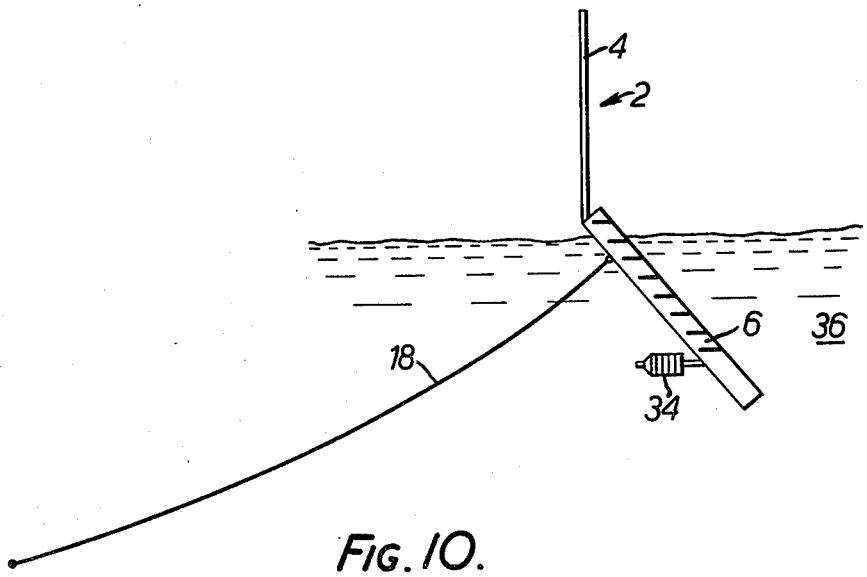

In FIG. 10, the hydrodynamic device 2 is shown attached to a 50 foot tow line 18 and the depth of tow can vary from 0 to 20 feet. The speed of tow can vary, depending upon the structural strength of the device 2, from 3 to 20 knots for example.

Figure 11:
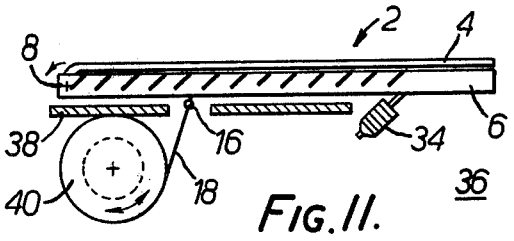
FIG. 11 shows the device of FIG. 5 in a stowed position.
Figure 12:
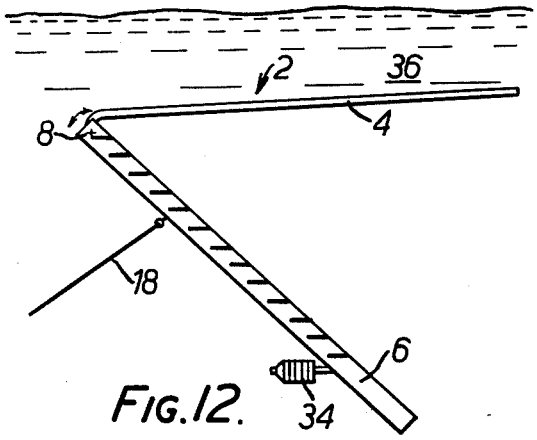
FIG. 12 shows the device of FIG. 5 in a partially open position.
Figure 13:
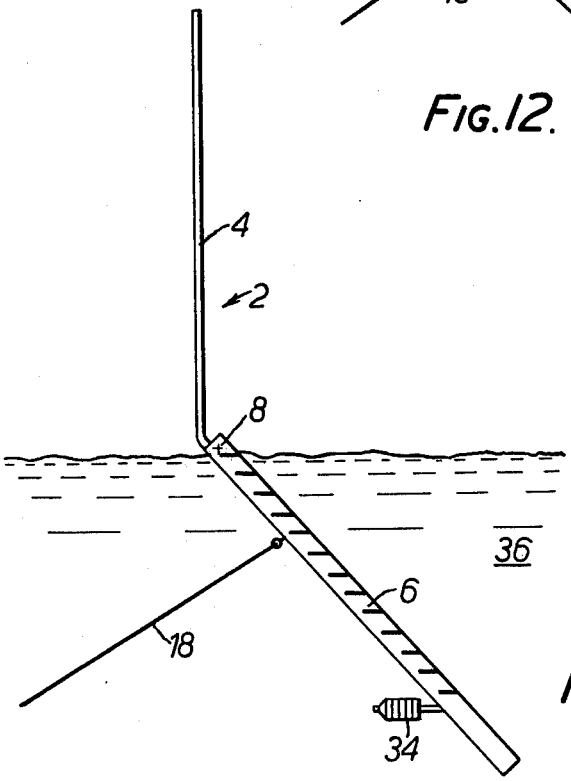
FIG. 13 shows the device of FIG. 5 in its fully expanded position.

In FIG. 11, the hydrodynamic device 2 illustrated in FIGS. 5 to 8 is shown in its stored position in which the first part 4 is lying adjacent the second part 6. The second part 6 is in fact stored on a platform 38 and the tow line 18 is wound around a winch drum 40. As the cable 18 is unwound from the drum 40, then the hydrodynamic device 2 unfolds as illustrated in FIGS. 12 and 13, FIG. 12 illustrating an intermediate unfolded position and FIG. 13 illustrating the fully unfolded position. The platform 38 can be submerged so that the hydrodynamic device 2 can be launched substantially automatically from a submerged condition.

Figure 14:
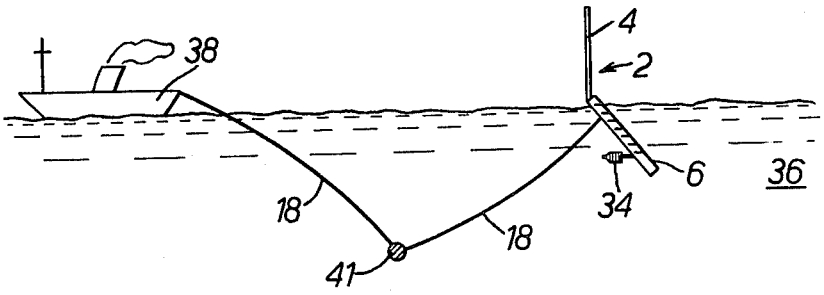
FIGS. 14 and 15 show two methods of towing the hydrodynamic device illustrated in FIG. 5.
Figure 15:
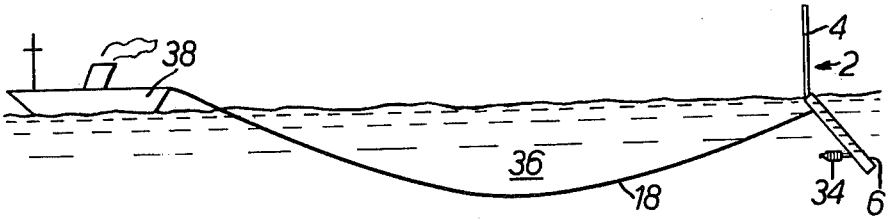

Referring now to FIGS. 14 and 15, the hydrodynamic device 2 illustrated in FIGS. 5 to 8 is shown being towed by a vessel 38. In FIG. 14, a sinker or depressor device 41 is attached to the tow line 18 so that the device is much closer to the vessel in FIG. 14 than in FIG. 15 where the sinker or depressor device 41 is not employed.

It is to be appreciated that the embodiments of the invention described above have been given by way of example only and that modifications may be effected. Thus, for example, the weighting arrangements 20, 22, 24 or 34 can be built into the second part 6 to form a part of the second part 6. Also, the first part 4 of the hydrodynamic device 2 has been illustrated as a flexible aerial but this first part 4 of the hydrodynamic device 2 could also be a marker device, a target or a radar reflector. Also, different types of hinge 8 can be employed. If the first part 4 is small then a rigid attachment to part 6 such that it becomes merely an extension to the top of the main part 6 could be envisaged.

We claim:

1. A hydrodynamic device comprising first and second parts which are connected together such that the first part is movable from a storage position in which it lies adjacent to the second part to an operable position in which it stands up and extends from one end portion of the second part, the second part comprising an elongate fairing member having a plurality of transversely extending hydrofoil elements, single towing means for enabling a single connection to be made between said hydrodynamic device and a towing vessel, and counterbalance weight means for providing a counterbalance weight, said counterbalance weight means and said elongate fairing member acting together to maintain vertical stability for the hydrodynamic device, whereby the hydrodynamic device can be towed in water by the single towing means with the first part visible above the water and the second part submerged;

wherein said counterbalance weight means comprises at least one weight positioned on an end portion of the second part, said end portion being remote from the first part;

said device further comprising a rectangular damper plate connected to said at least one weight.

2. A hydrodynamic device according to claim 1 wherein the first and second parts are connected together by a sprung hinge arrangement.

3. A hydrodynamic device according to claim 2, wherein the first and second parts are so connected together that the first part lies substantially exactly flat when in a stored condition.

4. A hydrodynamic device according to any one of claims 1, 2 or 3, wherein the hydrofoil elements are spaced apart by spacer elements.

5. A hydrodynamic device according to any one of claims 1, 2 or 3, wherein the single towing means comprises a towing eye.

6. A hydrodynamic device according to any one of claims 1, 2 or 3, wherein said counterbalance weight means comprises a plurality of weights positioned on an end portion of the second part, said end portion being remote from the first part.

7. A hydrodynamic device according to claim 1, wherein said second part has a cross-section shaped like an ellipse having one end tapered to an angle, whereby to enhance vertical stability of said hydrodynamic device.

8. A hydrodynamic device, comprising first and second parts which are connected together such that the first part is movable from a storage position in which it lies adjacent to the second part to an operable position in which it stands up and extends from one end portion of the second part, the second part comprising an elongate member having a plurality of transversely extending hydrofoil elements, and towing means for enabling a connection to be made between the hydrodynamic device and a towing vessel, whereby the hydrodynamic device can be towed in water with the first part visible above the water and the second part submerged, wherein the pair of hydrofoil elements that are uppermost when the device is being towed through the water are provided with drag vanes for controlling the depth at which the second part is submerged.

* * * * *